United States Patent [19]

Schuster

[11] 4,022,324

[45] May 10, 1977

[54] SEALED CONTAINER FOR STORING MEDICAL AND/OR BIO-MEDICAL ARTICLES IN STERILE CONDITION AND HAVING REMOVABLE COVER

[76] Inventor: Samuel J. Schuster, 1099 Hillside St., Monterey Park, Calif. 91754

[22] Filed: Apr. 10, 1975

[21] Appl. No.: 566,942

[52] U.S. Cl. ..... 206/439; 206/210

[51] Int. Cl.[2] ..... B65D 33/18

[58] Field of Search ..... 206/439, 210

[56] References Cited

UNITED STATES PATENTS

| | | | |
|---|---|---|---|
| 3,061,087 | 10/1962 | Scrivens et al. | 206/439 |
| 3,202,271 | 8/1965 | Kirk | 206/498 |
| 3,472,369 | 10/1969 | Schuster | 206/439 |
| 3,761,013 | 9/1973 | Schuster | 206/439 X |

*Primary Examiner*—William Price
*Assistant Examiner*—Joseph M. Moy
*Attorney, Agent, or Firm*—Fraser and Bogucki

[57] ABSTRACT

A container is disclosed including a relatively rigid tray sealed by a removable cover comprising a pair of plastic, bacteria-impermeable panels defining a generally linear passage for the introduction of sterilizing vapor for sterilizing the contents of the container after sealing thereof. The passage is sealed by a membrane, such as a paper strip, bonded to the panels about the passage. The paper strip is impermeable to bacteria but highly permeable to the sterilizing vapor.

The passage may be defined by overlapping margins of the plastic panels. Covers employing panels with overlapping margins may include discrete spaced-apart heat seals joining the margins along the length of their overlap to increase the strength of the cover and insure its removal in one piece. By making the panels of transparent plastic sheet material and using a paper strip having a small surface area relative to the overall surface area of the cover, the contents may be readily identified visually through the panels.

6 Claims, 4 Drawing Figures

SEALED CONTAINER FOR STORING MEDICAL AND/OR BIO-MEDICAL ARTICLES IN STERILE CONDITION AND HAVING REMOVABLE COVER

BACKGROUND OF THE INVENTION

1. Field of the Invention

The present invention relates generally to improved, sealed containers enclosing medical and/or bio-medical articles for gas sterilization after packaging and storing such articles in sterile condition, and particularly to containers of the described class having readily removable covers.

2. Background of the Invention

There are presently in use various forms of bacteria-impermeable containers for storing in sterile condition articles of a medical or bio-medical nature. One kind of container comprises a relatively rigid tray sealed by a removable cover a portion or all of which is made of a material highly permeable to sterilizing vapors such as ethylene oxide or steam thereby permitting sterilization of the contents after the container has been sealed. The sterile article is removed from the tray by peeling back the cover which is typically heat sealed to the rim of the tray.

The covers of known containers of this kind have various disadvantages. For example, some have small windows or ports covered by a patch of vapor-permeable material. The manufacture of such covers requires exact registration between the port, patch and the mechanism that seals the patch to the cover thereby necessitating the use of additional apparatus which substantially increases the cost of the final product. Moreover, because of the small area of the port, the breathability is often insufficient to permit an adequate rate of penetration and removal of the sterilizing vapor without risk of rupturing the container.

Furthermore, various cover materials presently in use are opaque thereby making impossible the verification of the contents of the container short of removal of the cover. Such verification prior to removal of the cover is important, for example, where the contents of the container comprise a specific set of surgical instruments for use in connection with a particular surgical procedure.

One cover material in wide use is "Tyvek", a spun polyolefin of the du Pont Company. "Tyvek", however, is not only opaque but is very expensive and must be coated with bonding agents such as heat sealable lacquers or resins in order to seal it to the tray. But such coatings reduce the breathability of "Tyvek", sometimes to a point where the rate of transfer of the sterilization vapor is insufficient. Efforts have been made to coat such covers with bonding agents or heat seal layers in only those places where a seal is to be effected so as not to limit breathability. However, this raises problems of registration. For example, peripheral coatings of bonding agents must be properly positioned with respect to both the printing on the cover and the tray to which the cover is to be attached. Such localized coating can, of course, be accomplished but it raises manufacturing difficulty and costs substantially.

Lastly, the covers of certain containers often tear when an attempt is made to remove them. This results in non-sterile parts of the cover or debris from the torn portions of the cover coming in contact with the contents of the container. It is desirable therefore that the cover be removable from the tray as a single piece without tearing and that the separation of the cover and tray not produce any loose fibers or debris.

SUMMARY OF THE INVENTION

The container of the present invention includes a relatively rigid, bacteria-impermeable tray carrying a medical or bio-medical article and sealed by a cover which, in accordance with one aspect of the invention, is constructed so as to be easily and inexpensively manufactured, and have excellent "breathing" characteristics. In this connection, the cover comprises a pair of panels preferably formed of bacteria-impermeable plastic sheet material and defining between them a generally linear passage extending the length of the cover and through which the sterilizing vapor is admitted to the interior of the container and withdrawn therefrom. The passage is covered by a bacteria-impermeable, sterilizing vapor-permeable membrane attached to the panels by a continuous bond on either side of the passage and extending parallel with the passage. The cover is thereby easily manufactured on existing package-making machinery by feeding continuous webs of plastic sheet material in side-by-side or partially overlapping relationship, together with a web of membrane material overlying both of the plastic webs, past apparatus that applies parallel, continuous bonds to secure the membrane to each of the plastic webs. The composite web may then be cut to the desired cover lengths. As is well known, such fabrication process is not dimensionally critical and the problems stemming from the requirements of precise registration are therefore not present.

The cover is attached to a rim projecting from the tray by a continuous bond. Portions of the rim bond cross the ends of the membrane and intersect the previously mentioned membrane bonds. In this fashion, the ends of the membrane are secured to the panels and a continuous bond circumscribes the passage thereby completely sealing the container in relation to bacteria and like organisms. The rim bond securing the cover is rupturable and weaker than the panels, membrane and membrane-panel bonds so that the cover may be removed from the tray without tearing simply by peeling it back.

In accordance with another aspect of the invention, the panels are fabricated of transparent plastic sheet material, such as polyethylene, polypropylene, or the like, and the membrane comprises a strip of paper or the like having a surface area that is substantially smaller than the overall surface area of the cover overlying the interior space of the container. In this fashion, the article is readily identifiable through the transparent panels so that its nature may be verified before the cover is removed. Because of its length however, the strip provides adequate breathability so that the rate of transfer of sterilizing vapor is not impaired.

The sterilizing vapor passage may be defined by edges of the panels that are in close proximity to each other or in abutting relationship. Alternatively, as already suggested above, margins of the panels may overlap to define the passage. In the latter case, the overlapping margins may be joined by a series of discrete, spaced-apart bonds along the length of the passage to strengthen the cover and relieve the membrane of stresses during removal of the cover. Such construction helps assure that the cover can be removed without tearing and as a single entity.

The panels may also be formed of two plies of plastic sheet material having overlapping margins arranged to retain a uniform cover thickness to facilitate bonding thereof to the tray rim by a heat seal.

BRIEF DESCRIPTION OF THE DRAWINGS

Further objects, features and advantages of the present invention will be understood from the following detailed description when read in conjunction with the accompanying drawings in which.

DETAILED DESCRIPTION

At the outset, it should be noted that the thickness of the sheet material shown in the accompanying drawings have been exaggerated for clarity. Further, the term "sterilizing vapor" is intended to include ethylene oxide, steam, or the like, that is forced into the interior of a sealed container or package through a breatheable membrane and withdrawn under partial vacuum to effect sterilization of the contents of the container.

Figure 1:
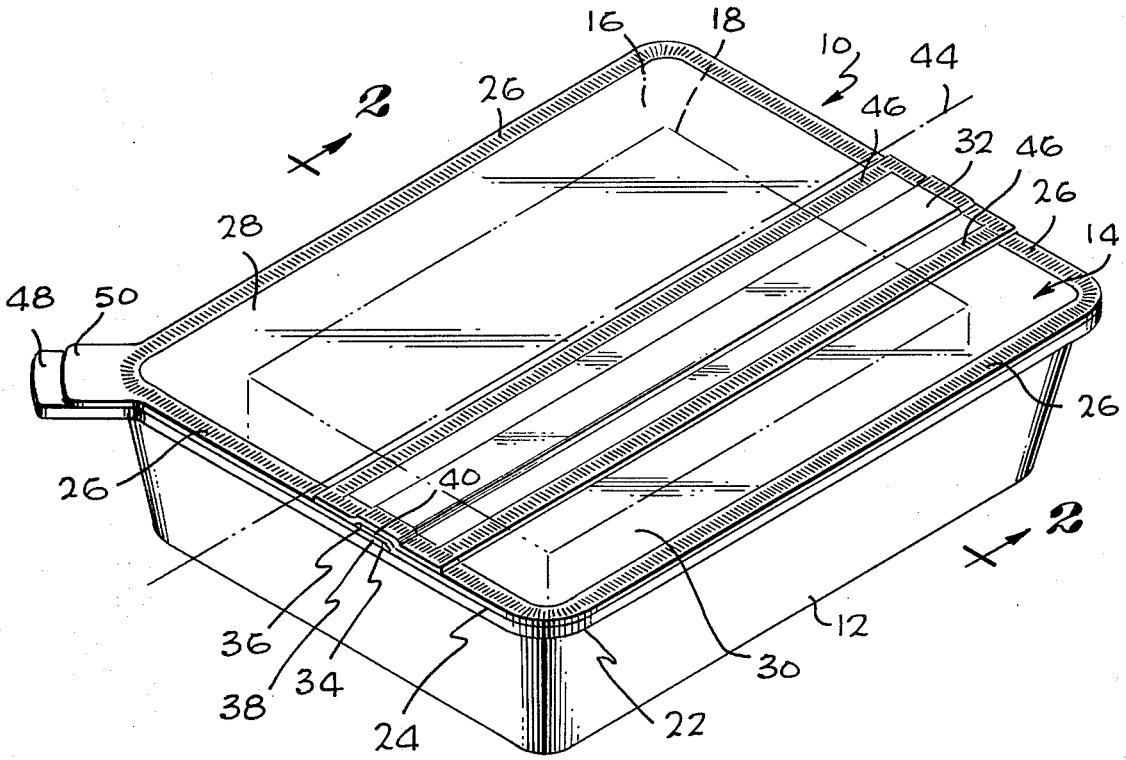
FIG. 1 is perspective view of a sealed, gas sterilizable container according to the present invention.
Figure 2:
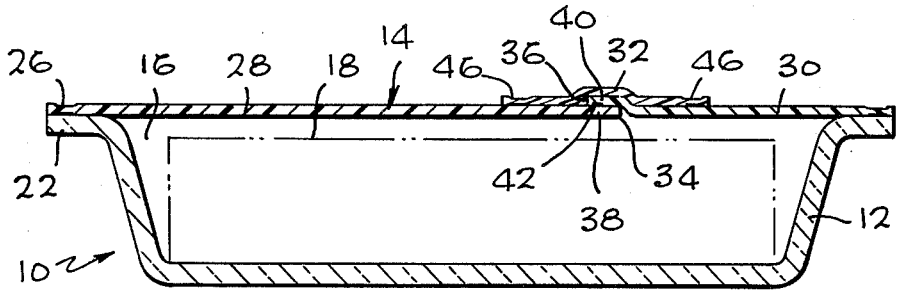
FIG. 2 is a cross-section view of the container of FIG. 1 taken along 2—2.

Turning now to FIGS. 1 and 2, there is shown a container 10 comprising a relatively rigid, thermoplastic tray 12 having a flexible, removable cover 14. The tray 12 and cover 14 define a sealed interior space 16 for retaining an article to be sterilized after packaging. The article may comprise one or more medical and/or biomedical items or any other article that is required to be sterilized and stored in sterile condition until use. By way of specific example, the article may consist of an insert 18 retaining a set of selected surgical instruments (not shown) for a particular surgical procedure.

For most purposes, the tray 12 will have a generally rectangular shape such as that shown in the drawings but it will be evident that other shapes such as circular or square may be employed. At least in its broader aspects, the invention is not limited to any particular tray geometry.

The tray 12 includes a rim 22 projecting outwardly from the upper edge of the tray and extending around the entire periphery thereof. The rim 22 has an upper, generally planar, horizontal surface 24 carrying the cover 14. The cover 14 may be bonded to the tray in any suitable manner. Preferably, however, the bond is a heat seal 26 extending around the entire periphery of the container so that a gas-tight seal is effected.

The cover 14 consists generally of three parts, namely, a pair of panels 28 and 30 and a bretheable membrane 32. Although various materials may be utilized the panels 28 and 30 will typically be fabricated of transparent thermoplastic sheet material such as polyethylene, polypropyele or the like about 2–3 mils thick. Such thickness is sufficient to render the panels essentially completely impermeable to bacteria. Various laminated plastic sheet materials may also be used to provide the necessary strength, integrity and ability to be processed. By way of example only, among such laminated materials are the following combinations: polyester sheet (mylar) laminated with polyethylene, polypropylene or surlyn sheet; polypropylene laminated with polyethylene; and nylon laminated with polyethylene. These materials, as is well known, may be extrusion-laminated or adhesive bonded, then coated with a suitable lacquer or heat-activated adhesive for subsequent sealing of the tray.

The panels 28 and 30 have parallel edges 34 and 36 respectively. Margins 38 and 40 adjacent the edges 34 and 36, respectively, overlap to define between them a passage 42 for the sterilizing vapor. In the embodiment under discussion the edges 34 and 36 are parallel with the longer sides of the tray 12.

The breatheable membrane 32 is typically in the form of a paper strip having adequate tear strength and the necessary sterilizing vapor transfer properties. The membrane, like the panels 28 and 30, is essentially completely impermeable to bacteria but unlike the panels, is highly permeable to the sterilizing vapor. Although paper is preferred because of its inexpensiveness and desirable vapor transfer and bacteria-impermeability properties, other materials such as "Tyvek" may be used instead.

The strip 32 extends the entire length of the container, lies parallel with the edges 34 and 36 and is heat sealed to the panels 28 and 30 by parallel, longitudinal heat seals 46 on either side of the overlapping margins 38 and 40 and by portions of the heat seal 26 along the shorter sides of the container. The heat seal 26 intersects the seals 46 so that the passage 42 is circumscribed by a continuous seal to provide a complete barrier to the movement of bacteria and like organisms through the passage.

If the strip 32 is made of paper, direct heat sealing of the strip to the panels 28 and 30 is made possible by treating the seal areas of the panels with a high voltage corona discharge. This eliminates the necessity of coating the strip with a bonding layer of polyethylene, or the like, which tends to impair the breatheability of the strip.

Further, to facilitate viewing of the article through the cover, the strip and passage 42 may be off-center relative to the longitudinal center line 44 of the container. The strip and passage may be centered, of course, or they may be oriented in virtually any direction relative to the sides of the tray. Still further in this connection, the strip 32 is relatively narrow so as to have a surface area that is small relative to the portion of surface area of the cover that overlies or is contiguous with the interior space 16. In this way, most of the article will usually be visible through the panels 28 and 30.

Projecting from one corner of the rim is a small handle 48. Overlying the handle 48 is a pull tab 50 formed as an extention of the panel 28. To remove the cover 14 the handle 48 is grasped with one hand and the pull tab 50 with the other. By pulling the cover sheet 14 back it will readily separate from the tray as the peripheral heat seal 26 is ruptured. The plastic materials mentioned, or their equivalents, help provide a particularly clean separation with minimum generation of loose debris.

As an alternative to the use of the handle 48 and pull tab 50, the cover 14 may be made somewhat larger than the tray. The portions of the cover 14 extending beyond the tray would thus serve as gripping surfaces for removing the cover.

To help retain the sterility of the contents of the container when they are removed it is highly desirable that the cover 14 be removed from the tray 12 as a single piece. To accomplish this the resistance of the panels 28 and 30, the paper strip 32 and the longitudinal heat seals 46 to tearing or rupturing will generally be greater than the rupture-resistance of the peripheral heat seal 26.

Figure 3:
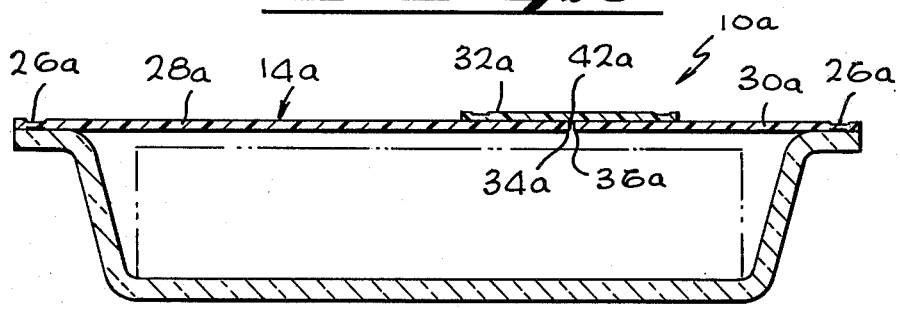
FIG. 3 is a cross-section view of a sealed, gas sterilizable container according to an alternative embodiment of the invention.

In FIG. 3 an alternative embodiment of the invention is shown comprising a container 10*a* having a cover sheet 14*a* including a passage 42*a* defined by abutting longitudinal edges 34*a* and 36*a* of panels 28*a* and 30*a*, respectively. A breatheable membrane in the form of a narrow paper strip 32*a* covers the passage 42*a* in a fashion already described in connection with the previous embodiment. Because there are no overlapping margins, and hence no differential thicknesses of the plastic panels along the rim in this example of the invention, the application of the rim heat seal 26*a* without burnthroughs or other deterioration is facilitated.

Figure 4:
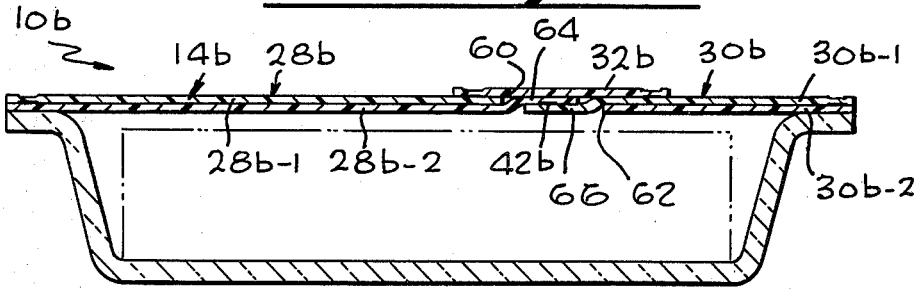
FIG. 4 is a cross-section view of a sealed, gas sterilizable container according to another embodiment of the present invention.

A uniform panel thickness to facilitate the joinder of the panels and rim is also made possible by another embodiment of the invention shown in FIG. 4 in which the container 10*b* includes a cover sheet 14*b* having two-ply transparent panels 28*b* and 30*b*. The panel 28*b* consists of an upper ply 28*b*-1 and a lower ply 28*b*-2; similarly, the panel 30*b* includes an upper ply 30*b*-1 and a lower ply 30*b*-2. The upper ply 28*b*-1 and lower ply 30*b*-2 have parallel edges 60 and 62, respectively, that are spaced-apart while the lower ply 28*b*-2 and upper ply 30*b*-1 have margins 64 and 66, respectively, that extend into the space between the edges 60 and 62 and overlap to define a passage 42*b*. A strip 32*b* is joined to the panels by heat seals on either side of the edges 60 and 62 to seal off the passage 42*b*. The cover 14*b* of this embodiment provides substantially greater strength while maintaining a uniform overall panel thickness making the application of the rim heat seal less critical. Another advantage of the dual ply construction is that it greatly enhances the bacteria-impermeability of the cover by virtually eliminating any possibility of bacteria entering the container through pinholes which may exist in the individual plies; in other words, the chances of pinholes in the plies being in alignment are extremely remote.

The plies comprising the panels 28*b* and 30*b* may be cohered mechanically such as by embossing or rolling the two plies together under slightly elevated temperature and pressure. Cohesion can be increased by treating the contacting surfaces with a corona discharge. Trapped air between the plies is thus eliminated and a relatively high strength structure results.

Figure 5:
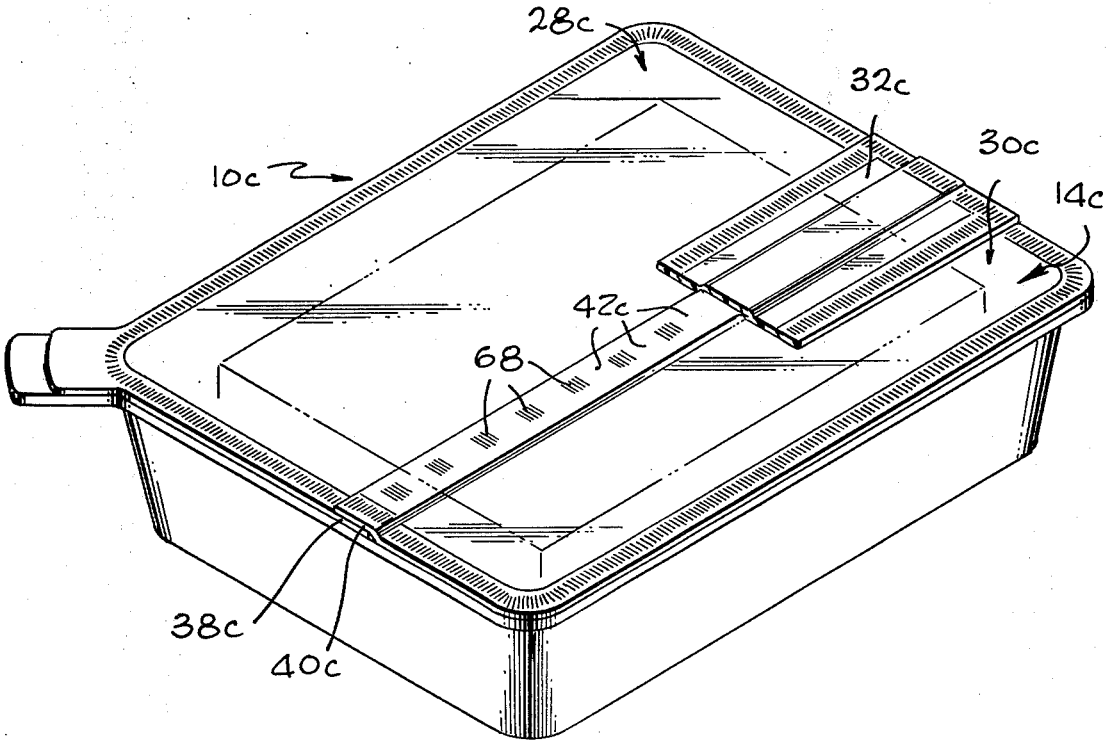
FIG. 5 is a perspective view, partially broken away, of a sealed, gas sterilizable container in accordance with yet another embodiment of the present invention.

FIG. 5 shows yet another embodiment 10*c* of the invention identical to that shown in FIGS. 1 and 2 except that it has a cover 14*c* designed to have greater strength to insure removal of the cover sheet as a single piece. The construction of cover 14*c* also eliminates stresses on the paper strip which tends to weaken when exposed to the autoclaving or steam sterilization process. The embodiment of FIG. 5 includes transparent panels 28*c* and 30*c* having overlapping margins 38*c* and 40*c*, respectively, under a paper strip membrane 32*c*. For additional strength a series of small, discrete, longitudinally-spaced heat seals 68 join the overlapping margins 38*c* and 40*c*, preferably along the entire lengths of the margins. The seals 68 may be applied so as to join the membrane 32*c* to the overlapping margins 38*c* and 40*c*, as well. The sterilizing vapor enters and leaves the interior of the container through the passages 42*c* between the heat seals 68. In this way, stresses imposed on the cover 14*c* during removal thereof will tend to be carried by the heat seals 68 instead of the paper strip 32*c*.

The cover of the various embodiments of the invention lends itself to low-cost fabrication on existing package-making machines such as the "Simplex" manufactured by FMC Corporation, Green Bay, Wisconsin. Generally, the panels 28 and 30 are fed as continuous webs in either side-by-side or overlapping relation, together with a web of membrane material overlapping both panel webs, past a bonding station where the longitudinal bonds (typically heat seals) and the series of spaced seals 68 are continuously applied. The composite web structure is then cut to the appropriate lengths and the individual covers are applied by means of the rim bond 26 (also typically a heat seal) to the tray 12 retaining the article to be sterilized. Sterilizing vapor is then introduced into the interior space 16 through the membrane 32 and passage 42 and withdrawn after the required residence time. The container is then ready for storage and subsequent use.

What is claimed is:

1. A sealed container enclosing an article, the container permitting sterilization of the article by a sterilizing vapor after packaging of the article, the container being adapted to store the article in sterile condition and comprising:

a tray having a peripheral rim; and a flexible, removable cover bonded to the rim along the entire peripheral extent thereof to define with the tray a sealed interior space within which the article is retained, the cover having an overall surface area overlying the interior space and including:

transparent, bacteria-impermeable panel means defining a generally linear passage extending between portions of the rim, the passage permitting the introduction into, and removal from, the interior space of the sterilizing vapor, the panel means including a pair of overlapping margins defining the passage, the overlapping margins being joined by a series of discrete, spaced bonds along the length of the margins to increase the strength of the cover; and a bacteria-impermeable, sterilizing vapor-permeable membrane covering the entire length of the opening, the membrane being attached to the transparent panel means by a continuous bond about the passage, the surface area of the membrane being substantially less than the overall surface area of the cover to facilitate visual identification of the article through the transparent panel means.

2. A sealed container, as defined in claim 1, in which the cover includes an outwardly-extending pull tab to facilitate removal of the cover and in which such removal is effected by pulling on the tab thereby rupturing the bond between the cover and the rim of the tray.

3. A sealed container adapted to be penetrated by sterilizing vapor and enclosing an article, the container comprising:

a relatively rigid, bacteria-impermeable tray having an outwardly projecting, continuous rim extending about the entire periphery of the tray; and a flexible, removable cover attached to the tray by a continuous bond along the entire extent of the rim to define a sealed interior space within which the article is retained, the cover having a gripping means and a surface area contiguous with the interior space and comprising:

a pair of transparent, bacteria-impermeable panels, each panel having a margin, the margins overlapping and defining between them a generally linear, sterilizing vapor passage extending across the interior space from one portion of the rim to another portion of the rim, the overlapping margins being joined by a plurality of discrete, spaced bonds along the passage to increase the strength of the cover; and a strip overlying the passage and extending the length thereof, the strip being impermeable to bacteria but permeable to the sterilizing vapor, the strip being attached to the panels by a continuous bond on each side of the passage and extending the length thereof and by the rim bond adjacent the ends of the passage; the rim bond intersecting the continuous bonds along the strip, the surface area of the strip being substantially less than the surface area of the cover to facilitate visual identification of the article through the transparent panels, the cover being removable from the tray as a single piece by grasping the gripping means and pulling the cover back thereby rupturing the rim bond.

4. A sealed container adapted to be penetrated by a sterilizing vaor and enclosing an article, the container comprising:

a relatively rigid, bacteria-impermeable tray having a pair of opposed, parallel longitudinal side, a pair of opposed, parallel transverse sides and an outwardly projecting, continuous rim disposed about the entire periphery of the tray; and a flexible, removable cover sealing the tray, the cover being attached to the rim by a continuous heat seal along the entire extent of the rim, the cover and tray defining a sealed interior space retaining the article, the cover having a pull tab and a surface area contiguous with the interior space, the cover comprising:

a pair of transparent, bacteria-impermeable plastic panels, each panel having a margin, the margins overlapping and defining between them a longitudinal passage permitting ingress and egress of the sterilizing vapor and extending the entire length of the interior space, the overlapping margins being joined by a plurality of discrete, spaced bonds along the passage to increase the strength of the cover; and a longitudinal strip covering the passage and having opposed ends overlying portions of the transverse side of the rim being impermeable to bacteria but permeable to the sterilizing vapor, the strip being bonded to the panels by a continuous, longitudinal heat seal on either side of the passage and extending the length of the container and by the rim heat seal along the opposed ends of the strip, the rim heat seal intersecting the longitudinal heat seals, the strip having a surface area substantially less than the surface area of the cover to facilitate visual identification of the article through the transparent panels, the cover being removable from the tray by grasping the pull tab and pulling the cover back to rupture the rim heat seal.

5. A sealed container enclosing an article, the container being penetrable by sterilizing vapor to sterilize the article after packaging, the container comprising:

a relatively rigid, bacteria-impermeable cover attached to the rim by a rupturable bond, the cover defining with the tray a sealed, interior space within which the article is retained, the cover comprising:

a pair of panels defining between them a generally linear passage extending across the interior space, the passage being defined by overlapping margins of the panels, the overlapping margins being joined by a series of spaced, discrete bonds to increase the strength of the cover; and a sterilizing vapor-permeable membrane covering the passage, the membrane being attached to the panels by a continuous bond circumscribing the passage, the continuous bond including linear bond portions extending generally parallel with the passage, the cover being removable as a single piece by pulling it back to separate the rupturable rim bond.

6. A sealed container, as defined in claim 5, in which: the panels are formed of transparent sheet material and the membrane is in the form of a narrow strip rendering at least a portion of the article visually identifiable through the transparent panels.

* * * * *